US005818432A

United States Patent [19]

Tsutsumi

[11] Patent Number: 5,818,432

[45] Date of Patent: Oct. 6, 1998

[54] CHARACTER GENERATOR AND VIDEO DISPLAY DEVICE USING THE SAME

[75] Inventor: Kunihiro Tsutsumi, Kyoto, Japan

[73] Assignee: Rohm Co., Ltd., Kyoto, Japan

[21] Appl. No.: 945,714

[22] Filed: Sep. 15, 1992

[30] Foreign Application Priority Data

Sep. 18, 1991 [JP] Japan ..... 3-267099

[51] Int. Cl.[6] ..... G09G 5/24

[52] U.S. Cl. ..... 345/194; 345/189

[58] Field of Search ..... 340/750, 735, 340/747, 748, 751, 730, 798; 395/150, 151; 345/192, 194, 195, 193, 189, 190, 191

[56] References Cited

U.S. PATENT DOCUMENTS

| | | | |
|---|---|---|---|
| 3,988,728 | 10/1976 | Inoue et al. . | |
| 4,146,879 | 3/1979 | Nicholson et al. | 340/750 |
| 4,751,508 | 6/1988 | Matsushita | 345/195 |
| 4,772,883 | 9/1988 | Kitano | 345/192 |
| 4,783,650 | 11/1988 | Bugg | 345/192 |
| 4,837,564 | 6/1989 | Ogawa et al. | 340/748 |
| 4,847,787 | 7/1989 | Nishiyama et al. | 340/735 |
| 4,864,518 | 9/1989 | Kurita | 340/750 |
| 4,931,958 | 6/1990 | Takeda | 345/194 |
| 4,952,924 | 8/1990 | Chang et al. . | |
| 4,962,465 | 10/1990 | Saito et al. | 340/730 |
| 5,124,694 | 6/1992 | Dien | 340/750 |

FOREIGN PATENT DOCUMENTS

| | | |
|---|---|---|
| 2171279 | 8/1986 | United Kingdom . |
| 2222352 | 2/1990 | United Kingdom . |

*Primary Examiner*—Amelia Au

*Attorney, Agent, or Firm*—Fay,Sharpe,Beall,Fagan,Minnich & McKee

[57] ABSTRACT

Since the present invention includes a character pattern ROM 7*a* having no memory of upper and lower space data lines, there is an address determination circuit 28 and a selection circuit 29, and when a value of an address signal L is not within an actual memory range from "3" to "16", the address determination circuit outputs a false signal as a determination result upon which the selection circuit outputs character pattern lines each including only extra space data, so that it is possible to serve a similar function to that of a conventional one with a smaller memory capacity than that of the conventional one.

1 Claim, 4 Drawing Sheets

CHARACTER GENERATOR AND VIDEO DISPLAY DEVICE USING THE SAME

BACKGROUND OF THE INVENTION

1 . Technical Field

The present invention relates to a character generator and a video image display device employing the same and, in particular, the present invention relates to an improvement of a character generator for generating a signal of dot pattern of a character or symbol (referred to as "character pattern" hereinafter) for use in a video image display device such as a television apparatus, a video tape recorder (VTR) or a video camera, etc., which is adapted to superimpose a fringed character or symbol pattern on an image displayed on a display screen thereof.

2. Prior Art

FIG. 4 illustrates an operation of a conventional character generator 20 for superimposing characters or symbols on a display image. In FIG. 4, a letter G is selected to be displayed, as an example.

The character generator 20 preliminarily stores all of character patterns to be displayed in a read only memory (ROM) thereof and, in response to a character code G, selects a letter G corresponding thereto and generates its pattern. In FIG. 4, the pattern of the letter G is shown also in an enlarged scale to facilitate an understanding of the concept.

In this example, the character pattern, G, consists of 18 pattern lines (referred to as "character pattern lines" hereinafter) each consisting of a serial array of 12 dots. Thus, each character pattern is displayed as an image of a 18×12 dot matrix pattern. Each such character pattern is stored in the character generator as a bit pattern signal (referred to as "bit pattern" hereinafter) corresponding to the dot matrix pattern, with each dot being a bit having a binary value 1 or 0.

When an address-signal L is supplied to the character generator, a character pattern line corresponding to a value of the address signal L is selected from the 18 lines of the selected character pattern "G". For example, assuming that the value of the address signal L is "N", the character generator outputs a character pattern line "P" of 12 dots, normally in parallel, as a bit pattern signal.

A character video signal generator may generate a fringe pattern, on demand, for fringing each character pattern line selected to be displayed to emphasize the selected character pattern line or to prevent the selected character pattern line from being mixed in a background when it is displayed on a display screen. A fringe pattern for a character is generated by the character video signal generator on the basis of a relation of each dot with respect to dots surrounding the certain dot. Therefore, in order to generate a fringe for a certain character pattern line, character pattern lines vertically adjacent to the certain character pattern line are also necessary, that is, a total of 3 character pattern lines have to be output by the character generator for each selected character pattern line. Then, the fringe pattern is generated as a bit pattern by a serial conversion circuit, etc., included in the character video signal generator on the basis of dot values, i.e., bit values, of dots that are vertically and horizontally adjacent each dot of the certain character pattern line. For example, if a character pattern line to be displayed is indicated by the address signal L having a value "N", three character pattern lines "N−1", "N" and "N+1" are obtained from the character generator and the character video image generator circuit uses these three lines to generate a fringe pattern "Y" as a bit pattern for a certain dot on the basis that are values of dots of vertically and horizontally adjacent these lines to the certain dot.

Since, however, the generation of a fringe pattern itself is performed not in the character generator but in the serial conversion circuit, etc., as mentioned above, the character generator merely outputs 3 character pattern lines according to the address signal L.

In such case, the character generator for use in a video image display device in which a character pattern is to be displayed with fringe has to have character pattern lines which are composed of only space data above and below an actually effective character pattern, respectively. Further, in order to prevent vertically adjacent characters from being overlapped with each other, space data is further provided. In the example shown in FIG. 4, lines "1", "2", "17" and "18" are character pattern lines which are composed of only space data.

Describing this in more detail with an assumption that the character pattern line to be displayed is "N" as described previously, the character pattern lines "N−1", "N" and "N+1" are also accessed. For example, if N is 3, the character pattern line "2" must be also accessed and if N is "16", the character pattern line "17" must be accessed. Therefore, the character generator must have an extra memory space for these the character pattern lines "2" and "17" including only space data. That is, in order to fringe a character pattern, such extra memory capacity is required, which is undesirable, in producing such character generator at high integration density, in view of space problem and manufacturing cost.

SUMMARY OF THE INVENTION

An object of the present invention is to provide a character generator which does not require any extra memory capacity for fringe.

Another object of the present invention is to provide a character generator which has a reduced memory capacity, is high in integration density and is suitable to be built-in in a single chip IC.

Another object of the present invention is to provide a character generator which is compatible in function with a conventional character generator, but with reduced memory capacity.

A further object of the present invention is to provide a video image display device capable of displaying an image with fringe without necessity of extra memory capacity.

According to the present invention, the above objects can be achieved by providing a character generator which stores a plurality of character patterns, each including a plurality of display pattern lines each being constituted with a bit pattern including a plurality of bits, characterized by comprising a memory for storing the character pattern lines of the plurality of character patterns, an address determination circuit for determining whether or not a value of an address signal supplied thereto corresponds to any of stored character pattern lines of a character pattern selected according to a pattern code supplied thereto and outputting a determination signal and an output circuit for providing an output of the memory when the determination signal indicates that the address signal value corresponds to one of the stored character pattern lines and, otherwise outputs, a bit pattern signal corresponding to the space data.

The memory and the output circuit of the character generator according to the present invention comprise a character pattern read only memory (ROM) and a selection circuit, respectively. The character pattern ROM is adapted to store all of character patterns possibly to be displayed, each including a plurality of character pattern lines, to select, responsive to a character code supplied thereto, one of the character patterns corresponding thereto and output, responsive to an address signal supplied thereto, a bit pattern signal of the character pattern line selected from the character pattern according to the value of the address signal.

The address determination circuit provides a determination signal indicating whether or not the address signal has a value corresponding to any of the character pattern lines of the selected character pattern.

The selection circuit responds to the determination signal to provide a signal of a bit pattern of the selected character pattern line if it indicates that the address signal value corresponds to one of the character pattern lines and, otherwise, it provides a signal of bit pattern of a character pattern line composed of only space data.

The character pattern ROM, the address determination circuit and the selection circuit may be formed as a single chip IC.

Further, the video image display device according to the present invention includes the above mentioned character generator within a character video signal generation circuit which includes, in addition to the character generator, an address selection circuit, a display data random access memory (RAM) and a serial conversion circuit, and has a function to display a fringed character pattern.

The address selection circuit responds to a line selection signal for determining a vertical position on a display screen and a carry selection signal for determining a horizontal position to generate a first address signal and a second address signal, respectively, and responds to a fringe selection signal for outputting three character pattern lines.

The display data RAM stores all character codes being displayed and reads one of the character codes which is stored in an address indicated by the first address signal.

The character generator including the character pattern ROM, the address determination circuit and the selection circuit takes the form of a single chip IC and, in response to the character code and a second address signal, outputs a signal of bit pattern of a character pattern line in an address in the character pattern selected by the character code indicated by the second address signal.

The serial conversion circuit receives a selection signal from a microcomputer which indicates whether or not a fringe is required and, when a fringe is required, receives bit patterns for three character pattern lines in parallel to generate a fringe pattern for the character pattern line and outputs signals related to the fringe bit pattern and the bit pattern of the selected character pattern lines dot by dot serially in synchronism with a dot clock.

With such construction as mentioned above, when any one of character pattern lines of any character pattern stored in the character pattern ROM is accessed, a bit pattern of the accessed character pattern line is output in the same manner as in the conventional technique. When any one of space pattern lines such as "1", "2", "17" or "18" in FIG. 4 which, in the present invention, are not stored actually in the character pattern ROM is accessed to provide a fringe and/or to put a space for prevention of overlapping of vertically adjacent characters, the selection circuit provides a character pattern line including only space data in response to the result of determination from the address determination circuit. Therefore, the character generator according to the present invention functions as if extra space pattern lines are stored in the character pattern ROM thereof as in the conventional device.

Accordingly, the character generator according to the present invention is completely compatible functionally with the conventional character generator while requiring no memory capacity for storing such extra space pattern lines as those indicated by "1", "2", "17" and "18" in FIG. 4 and, particularly, an outer configuration and size of the character generator according to the present invention constructed as a single chip IC can be easily made compatible with the conventional character generator up to the level of mounting to a video image display device. Since it is possible to manufacture such character generator IC at an optimum integration density or in a small chip size, producibility thereof is improved, so that manufacturing cost of the character generator and hence the video image display device using the same can be reduced.

DETAILED DESCRIPTION OF THE PREFERRED EMBODIMENTS

Figure 1:
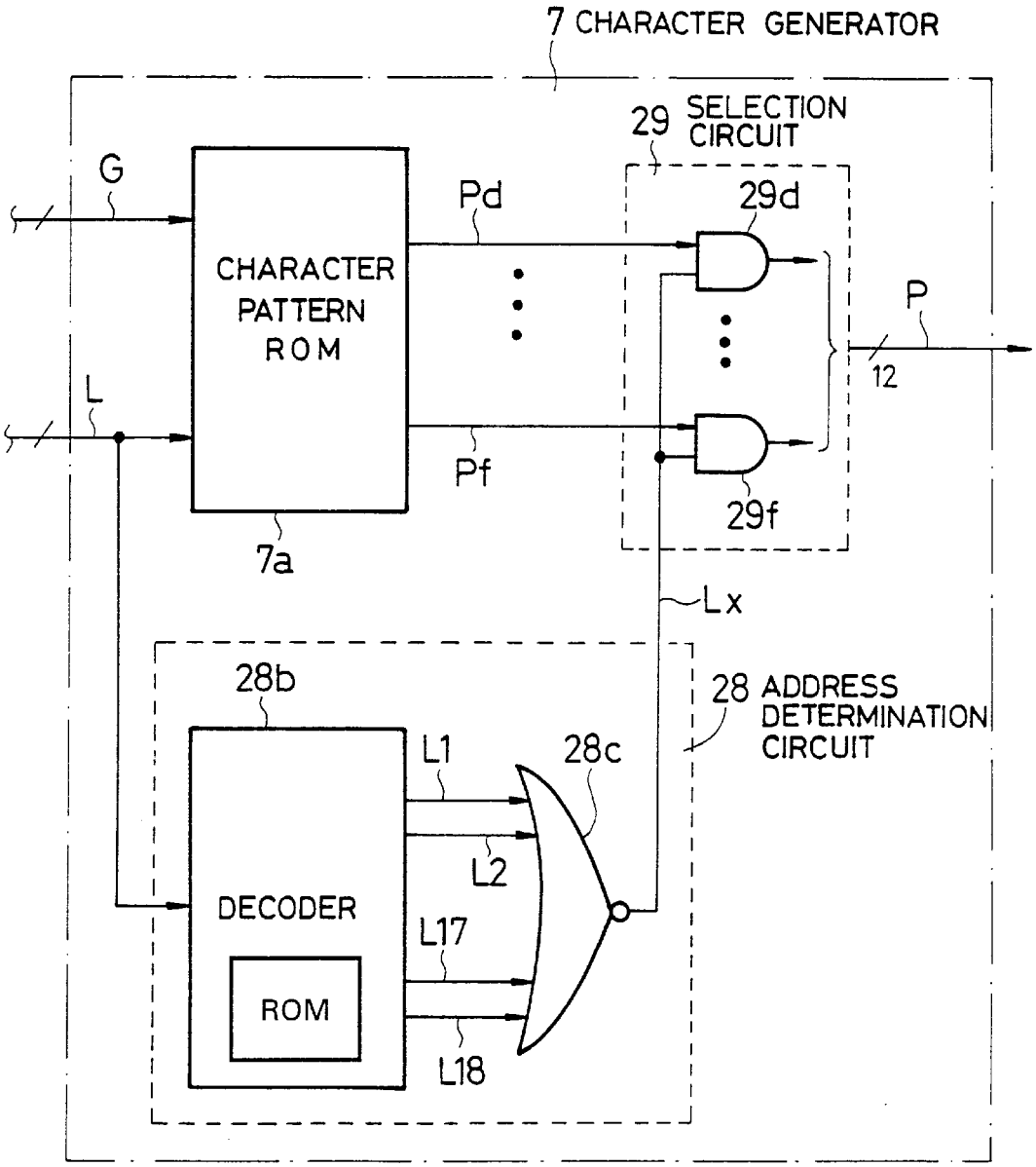
FIG. 1 is a block diagram of an embodiment of a character generator according to the present invention.

In FIG. 1, a character generator 7 includes a character pattern ROM 7*a*, an address determination circuit 28 and a selection circuit 29, and operates in response to a character code signal G and an address signal L. That is, as shown in FIG. 2 which illustrates an example of a content of the character pattern ROM 7*a*, the character generator 7 responds to the character code G supplied to the character pattern ROM 7*a* to select a character pattern "G" corresponding thereto, and responds to the address signal L also supplied to the character pattern ROM 7*a* to select a corresponding character pattern line "PP" in the character pattern "G" and output a bit pattern signal indicative of a character pattern line P.

Figure 2:
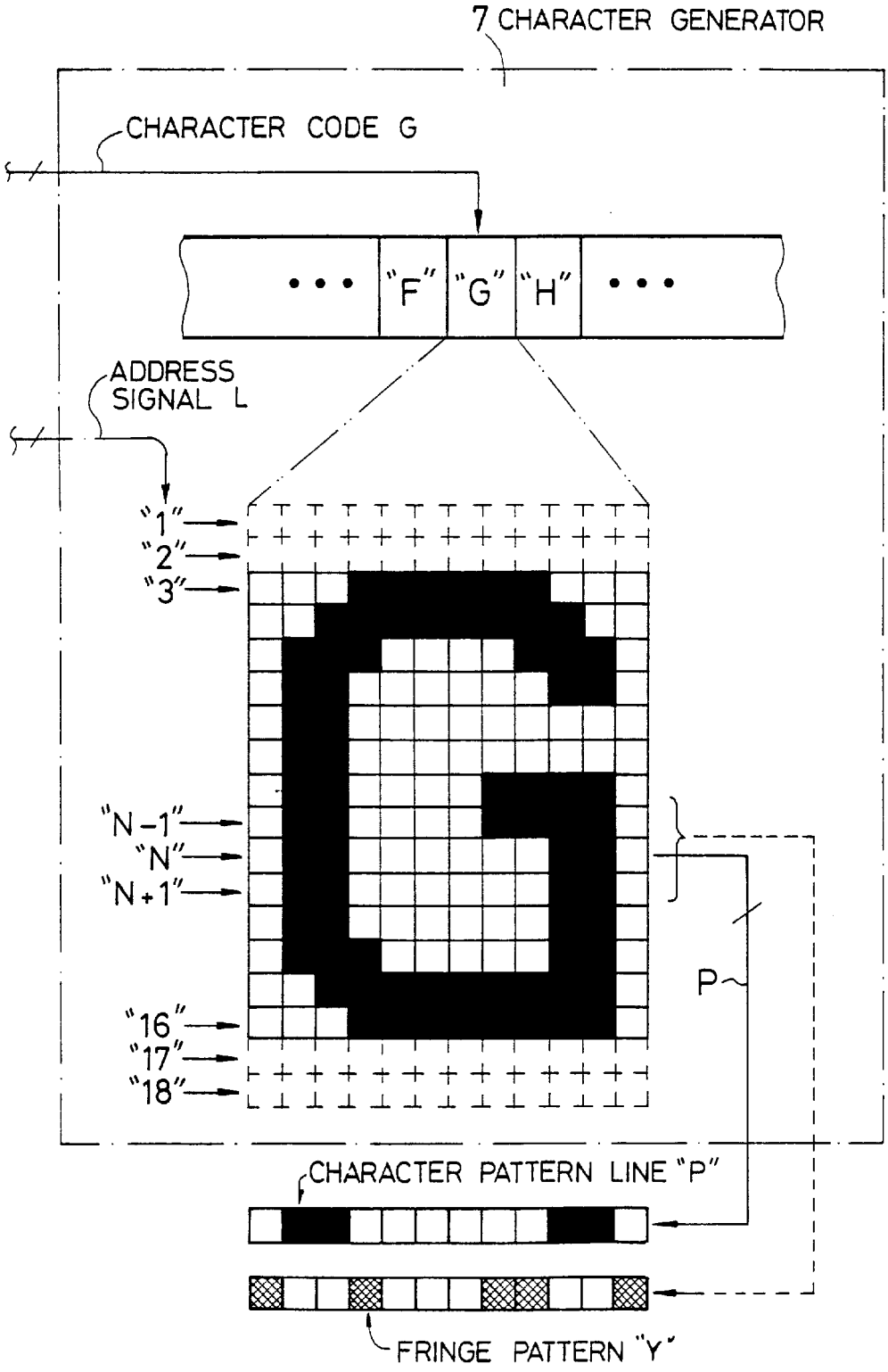
FIG. 2 illustrates a function of the character generator shown in FIG. 1.
Figure 4:
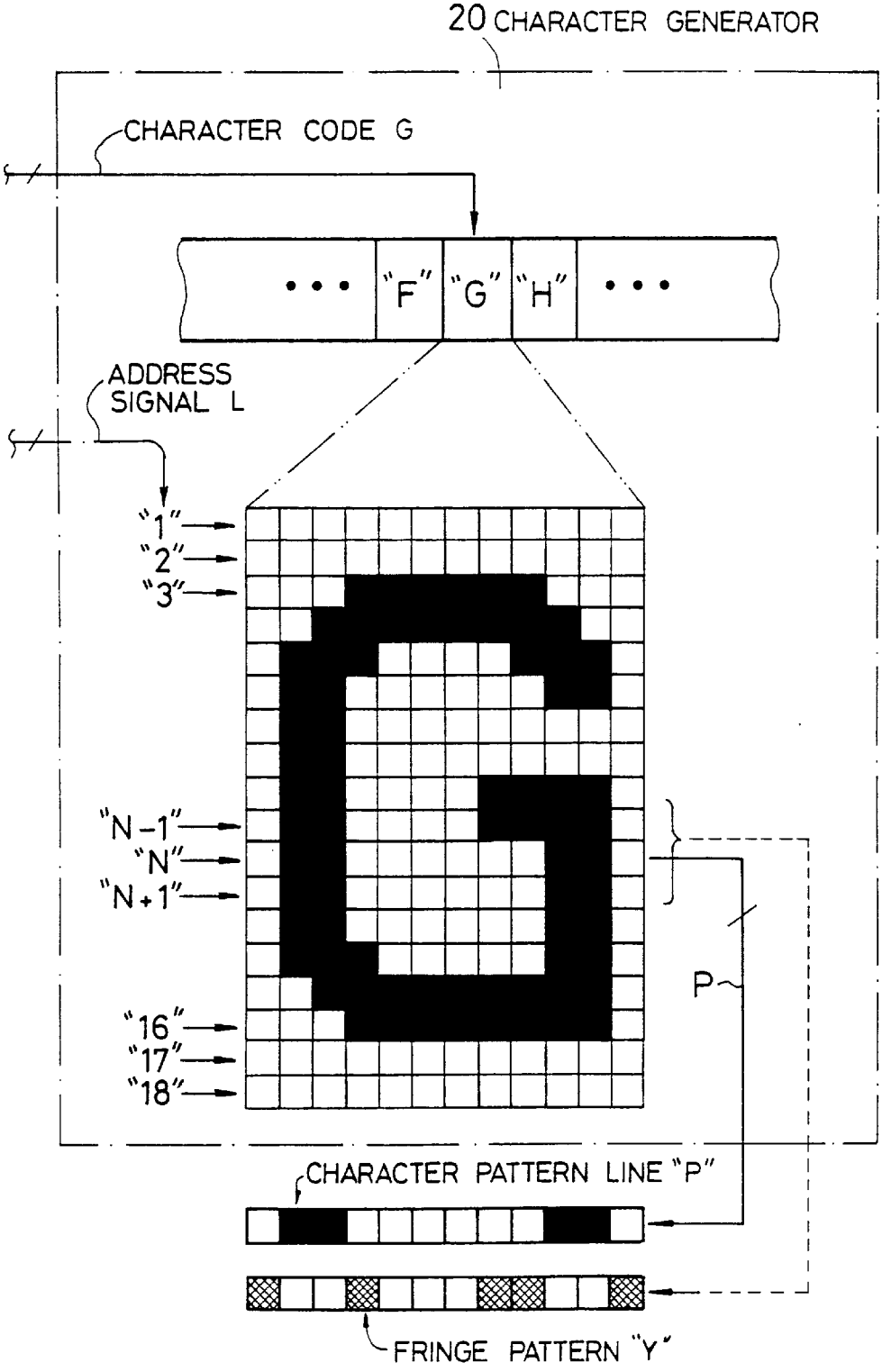
FIG. 4 PRIOR ART
FIG. 4 illustrates a function of a conventional character generator.

As shown in FIG. 2, the character pattern ROM 7*a* has preliminarily stored all character patterns which may be displayed, and each of which includes a plurality (in the shown example, 14) of character pattern lines that is less than the plurality of the character pattern lines shown in FIG. 4 (in the shown example, 18: 14 lines 3 to 16 of the character pattern "G" with 2 upper lines 1 and 2 and 2 lower lines 17 and 18). In other words, the character pattern ROM 7*a* in FIG. 1 has no memory area to store the upper and lower extra pattern lines shown in FIG. 4.

Therefore, the character pattern ROM 7*a* responds to the address signal L to select a character pattern line "P" corresponding to a value of the address signal L when the value is within the range from "3" to "16" and outputs its bit pattern signal in parallel (Pd–Pf). However, if the value of the address signal L is not within the range from "3" to "16", the output (Pd–Pf) is not constant since there is no corresponding memory.

On the other hand, the address determination circuit 28 is constituted with a decoder 28*b* and an inverted OR gate 28*c*.

The address signal L is also received by the decoder 28*b* which has outputs L1, L2, L17 and L18 and if the value of the address signal is within the range from "3" to "16", it outputs no signal on the output terminals L1, L2, L17 and L18. The OR gate 28*c* performs an OR operation of the signals on these terminals and inverts a result thereof. The inverted signal from the OR gate 28*c* is supplied to the selection circuit 29 as a determination signal Lx. That is, in the above mentioned case of L inside the range, the determination signal Lx is true, high level, "1". On the other hand, if the value of the address signal L is outside the range, that is, its value is 1, 2, 17 or 18, the determination signal Lx becomes false, low level, "0".

The selection circuit 29 is constituted with parallel AND gates 29*d*–29*f*. In a case where the determination signal Lx is true, "1", the gates 29*d*–29*f* receive the high level signal Lx respectively, and output signals Pd–Pf from the character pattern ROM 7*a*, which are indicative of a bit pattern line selected by the character code G and the address signal L, and output a suitable bit pattern line. This bit pattern line is fringed horizontally in the same manner as mentioned for the conventional technique. These procedures are repeated for other character lines, resulting in a character pattern with horizontal fringe.

For a vertical fringe, if the determination signal Lx is false, "0", that is, if the value of the address signal L is not within the range from 3 to 16, all of the outputs of AND gates 29*d*–29*f* become low level, "0". Therefore, a space bit pattern signal "0" constituted with 12 bits all having value 0 is produced when the value of the address signal L is not larger than 2 or not smaller than 17. Therefore, even when the value of the address signal L is not within the range from 3 to 16 and thus the outputs (Pd–Pf) of the character pattern ROM 7*a* are not constant, a bit pattern of character pattern lines each including only space data is output as the character pattern line P by means of the functions of the address determination circuit 28 and the selection circuit 29. These space data can be used to provide vertical fringes for the character pattern concerned.

Therefore, the character generator 7 of this embodiment can perform a similar function to that of the conventional one while its memory capacity is smaller than that of the conventional one by an amount corresponding to the extra four character lines necessary in the conventional memory, that is, a reduction of memory capacity of 14/18, that is, about 22% is realized in the present invention.

It is clearly understood by persons skilled in the art that, although the above description is for only character pattern "G", the same is applicable to any other character pattern stored in the character pattern ROM 7*a*.

The construction of the address determination circuit is not limited to that shown in FIG. 1 and may be constituted with a comparator circuit and a gate circuit or with a ROM, instead of the address determination circuit 28.

Further, the construction of the selection circuit 29 is not limited to that shown in FIG. 1 and may be constituted with a circuit using OR gates and/or NAND gates, etc,., instead of the AND gates, by changing the logic from positive to negative, or vice versa.

Figure 3:
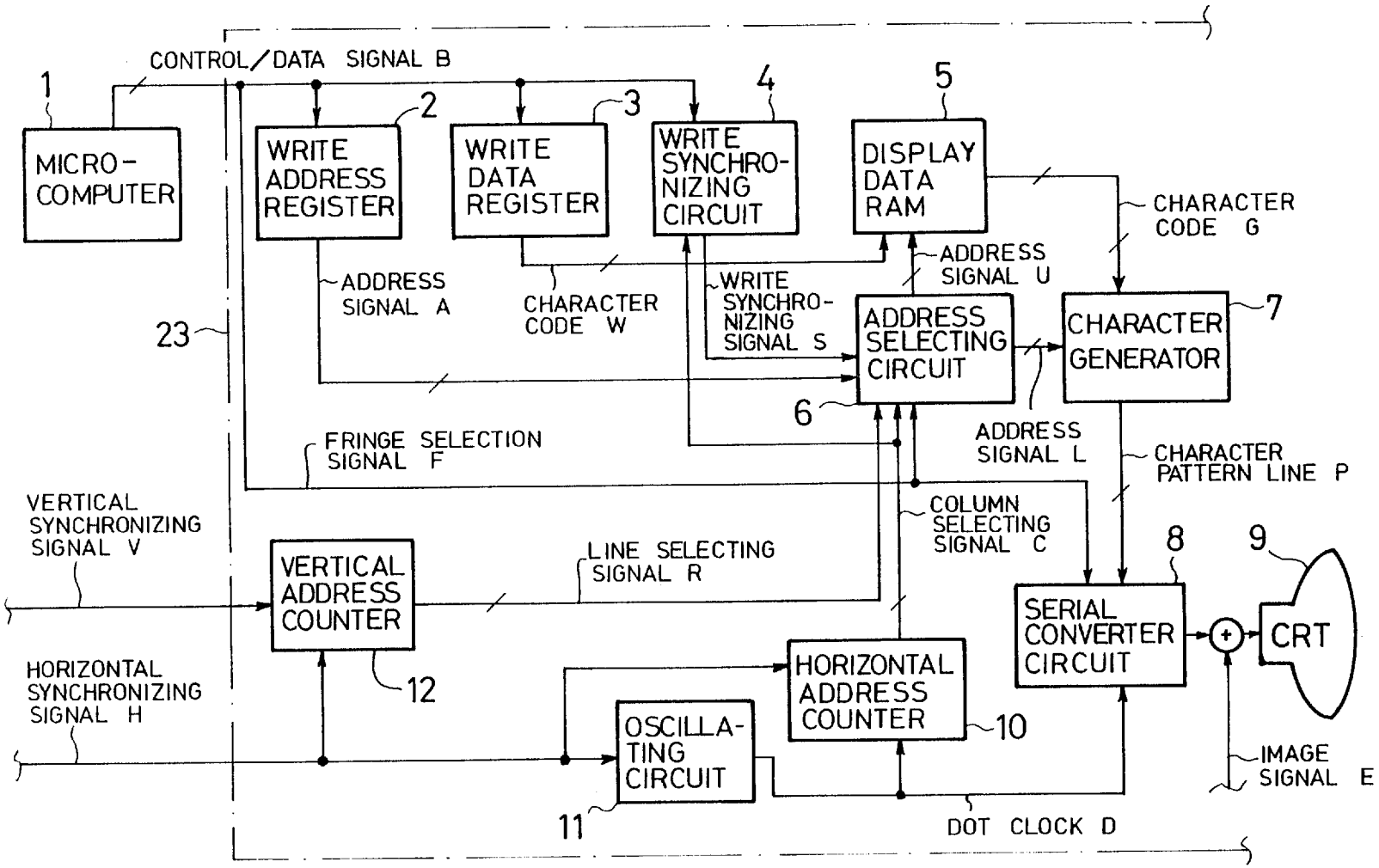
FIG. 3 is a block diagram of an embodiment of a video image signal generator circuit of a video display device according to the present invention.

FIG. 3 is a block diagram of an embodiment of the video image display device of this invention having a character video image signal generator circuit including the character generator 7 described with reference to FIGS. 1 and 2.

In FIG. 3, the character video image signal generator circuit 23 includes, in addition to the above mentioned character generator 7, an address selection circuit 6, a display data RAM 5, a serial conversion circuit 8 and other associated circuit components therewith.

The address selection circuit 6 receives, from a vertical address counter 12 to be described later, a line selection signal R for determining a vertical position on a display screen and, from a horizontal address counter 10 to be described later, a column selection signal C for determining a horizontal position from a write synchronizing circuit 4 a write synchronizing signal 5, from a writer address register 2 and address signal A, and produces an address signal U and an address signal L. This circuit 6 receives a fringe selection signal F from a microcomputer 1 and outputs three pattern lines "N−1", "N" and "N+1" when fringe is required. The microcomputer 1 sends control/data signal B to the write address register 2, the write data register 3 and the write synchronizing circuit 4, which later receives the column selecting signal C.

The display data RAM 5 stores all characters to be displayed. The display data RAM 5 responds to the address signal U and a character code W from a write data register 3 to select a character code among those stored therein and outputs the selected character code to the character generator 7 as the character code G, as mentioned previously. That is, the character generator 7 responds to the character code G to select the corresponding character pattern "G" and responds to the address signal L to select a character pattern line "P" of the character pattern "G" and outputs a bit pattern signal of the character pattern line P.

The serial conversion circuit 8 receives a fringe selection signal F from the microcomputer 1 indicating whether or not a fringe is required and, when it indicates a fringe request, produces a horizontal fringe pattern "Y" corresponding to the character pattern line "P" in response to upper and lower line patterns of the character pattern line "P" and outputs signals of the character pattern line "P" and the fringe bit pattern dot by dot serially for every dot clock D.

In order to read a character code G to be displayed from the display data RAM 5, the character video image signal generator circuit 23 further includes the vertical address counter 12, an oscillator circuit 11 and the horizontal address counter 10.

The vertical address counter 12 receives a vertical synchronizing signal V and a horizontal synchronizing signal H for synchronizing its operation with a scan line to generate a line selection signal R and sends the line selection signal R to the address selection circuit 6 to determine a vertical position of the character pattern line on the display screen.

In order to provide a timing during a horizontal scan, the oscillator circuit 11 receives the horizontal synchronizing signal H and produces a dot clock D synchronized in phase with a generating signal and having a period corresponding to horizontal scan time of respective display dots on the display screen.

The horizontal address counter 10 receives the horizontal synchronizing signal H and the dot clock D to produce a column selection signal C for determining a horizontal position on the display screen and sends it to the address selection circuit 6 and a write synchronizing circuit 4.

Steps for producing and displaying a video image of a character to be performed by the video image display device of such construction will be described hereinafter.

First, the vertical address counter 12 is initialized by the vertical synchronizing signal v and starts to count in response to the horizontal synchronizing signal H, the count being output as the line selection signal R for determining a vertical position of scan line. The oscillator 11 operates in synchronism in phase with the horizontal synchronizing signal H to produce the dot clock D of a frequency corresponding to the vertical scan speed of scan line. The horizontal address counter 10 is initialized by the horizontal synchronizing signal H and starts to count in response to the dot clock D, the count being output as a column selection signal C for determining a horizontal position of scan line.

Then, the address selection circuit 6 produces the address signal U and the address signal L by operating with the line selection signal R and the column selection signal C thus produced according to respective storing states.

The display data RAM 5 outputs a character code G corresponding to the address signal U and outputs to the character generator 7.

Further, the character generator 7 receives the character code G and the address signal L and outputs bit pattern signals of the character pattern line "P" and character pattern lines above and below the line according to the address signal L when a fringe is requested.

The serial conversion circuit 8 which receives these three character pattern lines produces a fringe pattern "Y" and outputs bit pattern signals of the character pattern "P" and the fringe pattern "Y" serially dot by dot.

The video signal produced in this manner by the character video image signal generator circuit 23 and serially output dot by dot is combined with another video image signal E, if any, and displayed on a CRT 9.

In an image screen, although when a white colored character pattern is displayed on a white background it is difficult to distinguish the character pattern without fringe, the character pattern is emphasized if black-fringed and easily distinguished regardless of background state.

In this manner, the video device of this invention can operates without difficulty, while using the character generator 7 having smaller memory capacity and being cheaper in cost than those of the conventional one, as described previously.

As described hereinbefore, the character generator of this invention does not require extra memory capacity while maintaining the complete functional compatibility with the conventional construction.

While a preferred embodiment has been set forth with specific details, further embodiments, modifications and variations are contemplated according to the broader aspects of the present invention, all as determined by the spirit and scope of the following claims.

I claim:

1. A video image display device comprising:

an address selector circuit responsive to a line selection signal for determining a vertical position on a display screen and a column selection signal for determining a horizontal position on the display screen to produce a first address signal and a second address signal;

a display data random access memory for storing all character codes to be displayed and reading and outputting one of said character codes stored in an address indicated by said first address signal;

a single chip IC character generator comprising a read only pattern memory for storing a plurality of character patterns each composed of a plurality pattern lines each composed of a bit pattern, and an address determination circuit and a selector circuit operable, in response to said character code and said second address signal, to select one of said character patterns corresponding to said character code and output a bit pattern signal of one of said pattern lines corresponding to said second address signal; and a serial converter circuit responsive to a fringe request signal from a microcomputer to generate a bit pattern of fringe for said bit pattern of said character pattern and output signals of said fringe bit pattern and said bit pattern of said character pattern dot by dot every clock having a period corresponding to a horizontal scan period of respective display dots on the display screen, wherein said read only pattern memory stores all of said pattern lines of each of said character patterns, and selects, in response to said character code, one of said character patterns and outputs said bit pattern of said selected character pattern corresponding to said second address signal when a value of said second address signal indicates any of said pattern lines;

wherein said address determination circuit responds to said second address signal to output a determination signal indicating whether or not a value of said second address signal indicates any of said pattern lines;

wherein said selector circuit responds to said determination signal from said address determination circuit and output of said read only pattern memory to output said output of said read only pattern memory when said determination signal from said address determination circuit indicates any of said character pattern lines, and responds to said determination signal and independently of an output of said pattern memory to output a bit Pattern signal of only space data when said result of the determination does not indicate that the value indicates one of said display pattern lines, so that said pattern memory does not need to store said bit patterns of said space display line;

wherein said selector circuit receives the bit pattern output from said pattern memory that corresponds to the display pattern lines and uncertain data bits respectively when the determination signal indicates and does not indicate that the value of the address signal indicates one of the display pattern lines, and in response to said determination signal respectively passes the bit pattern or generates space bits as character pattern line output of the character generator.

* * * * *